US012372235B1

(12) United States Patent
Bacon

(10) Patent No.: US 12,372,235 B1
(45) Date of Patent: Jul. 29, 2025

(54) FLARE GAS SYSTEM

(71) Applicant: David Bacon, Bastrop, TX (US)

(72) Inventor: David Bacon, Bastrop, TX (US)

( * ) Notice: Subject to any disclaimer, the term of this patent is extended or adjusted under 35 U.S.C. 154(b) by 0 days.

(21) Appl. No.: 18/666,608

(22) Filed: May 16, 2024

Related U.S. Application Data

(62) Division of application No. 17/167,541, filed on Feb. 4, 2021, now abandoned.

(51) Int. Cl.
*F23G 7/05* (2006.01)
*F23G 7/08* (2006.01)

(52) U.S. Cl.
CPC ..... *F23G 7/085* (2013.01); *F23G 2209/14* (2013.01)

(58) Field of Classification Search
CPC ..... F23G 7/085
See application file for complete search history.

(56) References Cited

U.S. PATENT DOCUMENTS

| | | | |
|---|---|---|---|
| 9,791,067 | B2 | 10/2017 | Kovash et al. |
| 9,970,657 | B2 | 5/2018 | Kovash et al. |
| 9,970,658 | B2 | 5/2018 | Kovash et al. |
| 10,584,873 | B1 | 3/2020 | Bacon |
| 2008/0164432 | A1 | 7/2008 | Matsch |
| 2014/0329186 | A1 | 11/2014 | McClain et al. |
| 2016/0290637 | A1 | 10/2016 | Noman et al. |
| 2020/0332999 | A1 | 10/2020 | Chambers et al. |

*Primary Examiner* — Jason Lau
(74) *Attorney, Agent, or Firm* — Werner IP Law, P.C.

(57) ABSTRACT

A flare gas system for flaring high and low pressure flare gases, the system including a first flare gas assembly that has a central air pipe and first and second conduits in surrounding relationship to the air pipe. There is a first annulus formed between the air pipe and the first conduit, and a second annulus formed between the first conduit and the second conduit. A flow restrictor is disposed in the second annulus. A first gas handler conveys a first flare gas to the first flare gas assembly. A second flare gas assembly is connected to the first flare gas assembly and has a tubular housing in which is disposed a pressure operated valve assembly. A second flare gas handler distributes a second flare gas between the second annulus and the tubular housing. A single igniter can be used to ignite the gas from the first flare gas assembly and multiple second flare gas assemblies.

14 Claims, 5 Drawing Sheets

FLARE GAS SYSTEM

FIELD OF THE INVENTION

The present invention relates to flares for burning waste gas and, more particularly, to a flare gas system for burning first and second flare gases, e.g., high pressure and low pressure flare gases.

BACKGROUND OF THE INVENTION

At oil and gas well sites, particularly where drilling is conducted in shale formations, there is an array of equipment, as for example tank batteries to collect crude oil and/or distillates from the oil and gas wells, as well as separators to separate gas/water from hydrocarbons. Generally speaking, tank batteries are a source of low pressure flare gas while separators are a source of high pressure flare gas. In either event, the gases cannot be allowed to accumulate as the pressure build up could create hazards to humans as well as potential damage to equipment. Nor can they be vented to atmosphere for environmental reasons. To alleviate this problem, these gases, both high and low pressure, are vented from the equipment and flared using a suitable flare gas assembly.

SUMMARY OF THE INVENTION

In one aspect, the present invention relates to a flare gas system for burning first and second flare gases.

In yet another aspect, the present invention relates to a flare gas system which can flare first and second gases, wherein one of the gases may be low pressure gas and the other high pressure gas.

In a further aspect, the present invention relates to a method of flaring both high and low pressure gases.

These and further features and advantages of the present invention will become apparent from the following detailed description, wherein reference is made to the figures in the accompanying drawings.

DETAILED DESCRIPTION OF PREFERRED EMBODIMENTS

The flare gas system of the present invention is designed to accommodate the flaring of both high pressure and low pressure flare gases. To this end, the flare gas system of the present invention has at least one low pressure flare gas assembly and at least one high pressure flare gas assembly, the high pressure and low pressure assemblies being married together to form at least one embodiment of the flare gas system of the present invention.

Figure 2:
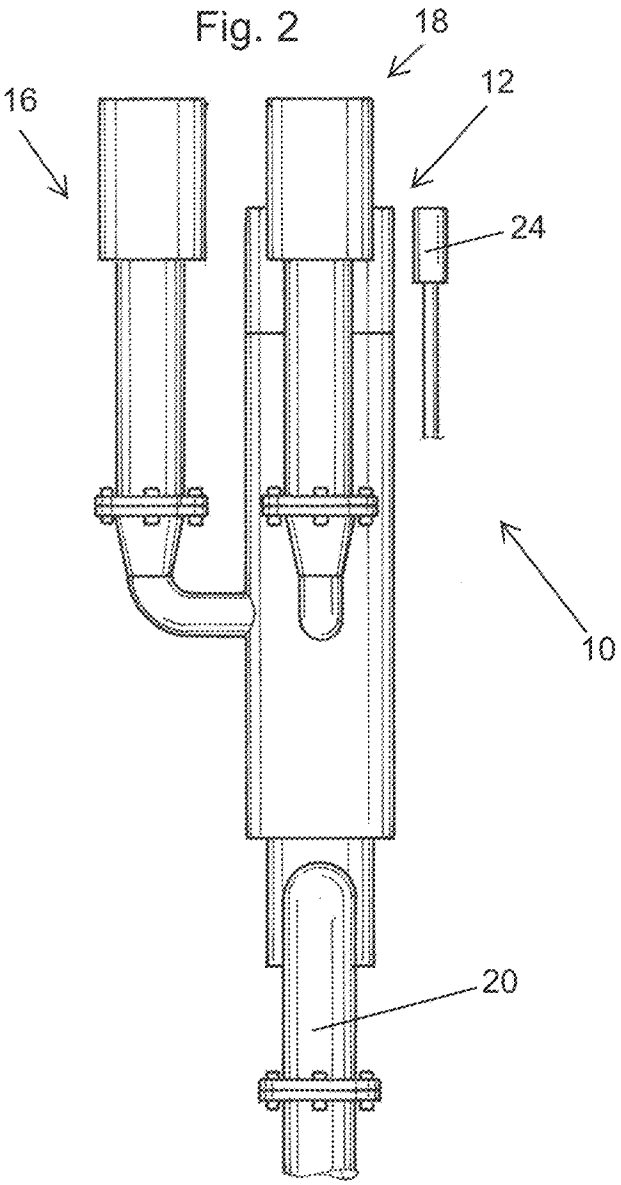
FIG. 2 shows the flare gas system of FIG. 1 rotated 90°.
Figure 1:
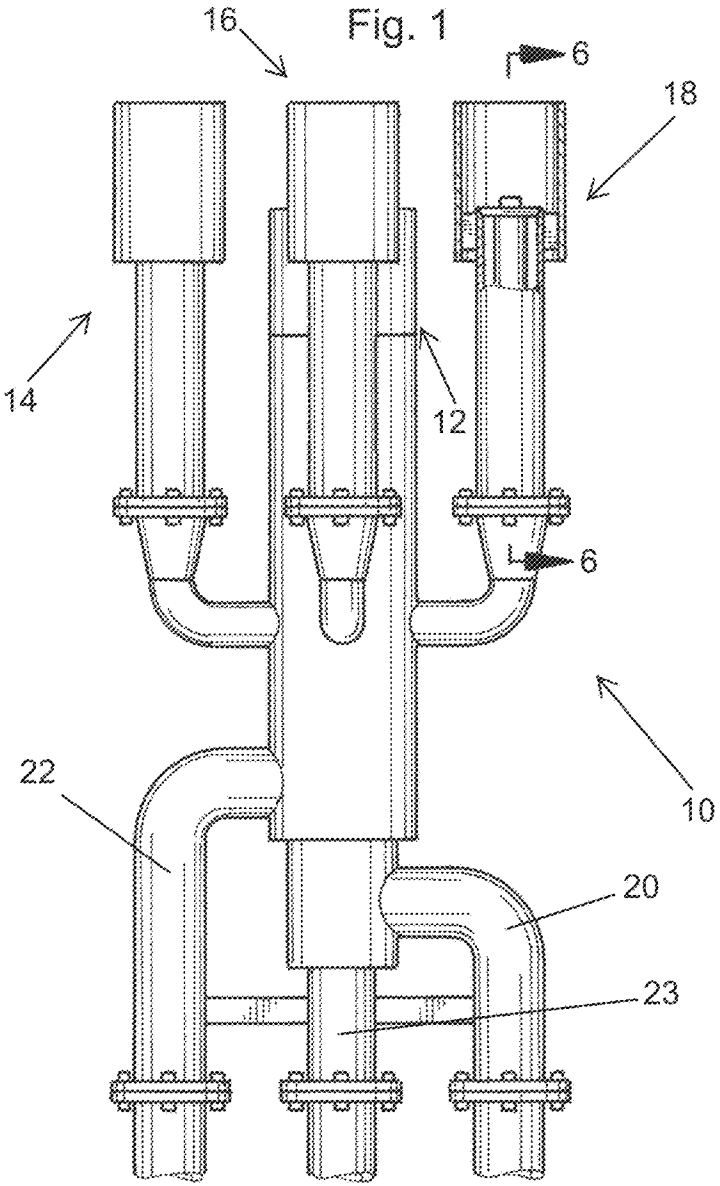
FIG. 1 is a perspective, elevational view of one embodiment of the flare gas system of the present invention.

Turning first to FIGS. 1 and 2, there is shown a flare gas system 10 in accordance with the present invention wherein there is a low pressure flare gas assembly shown generally as 12 and three high pressure flare gas assemblies shown generally as 14, 16, and 18. There is a first flare gas feed gas line 20 for conveying low pressure flare gas to low pressure gas assembly 12 and a second flare gas feed line 22 conveying high pressure flare gas to the high pressure flare gas assemblies 14, 16, and 18.

Figure 3:
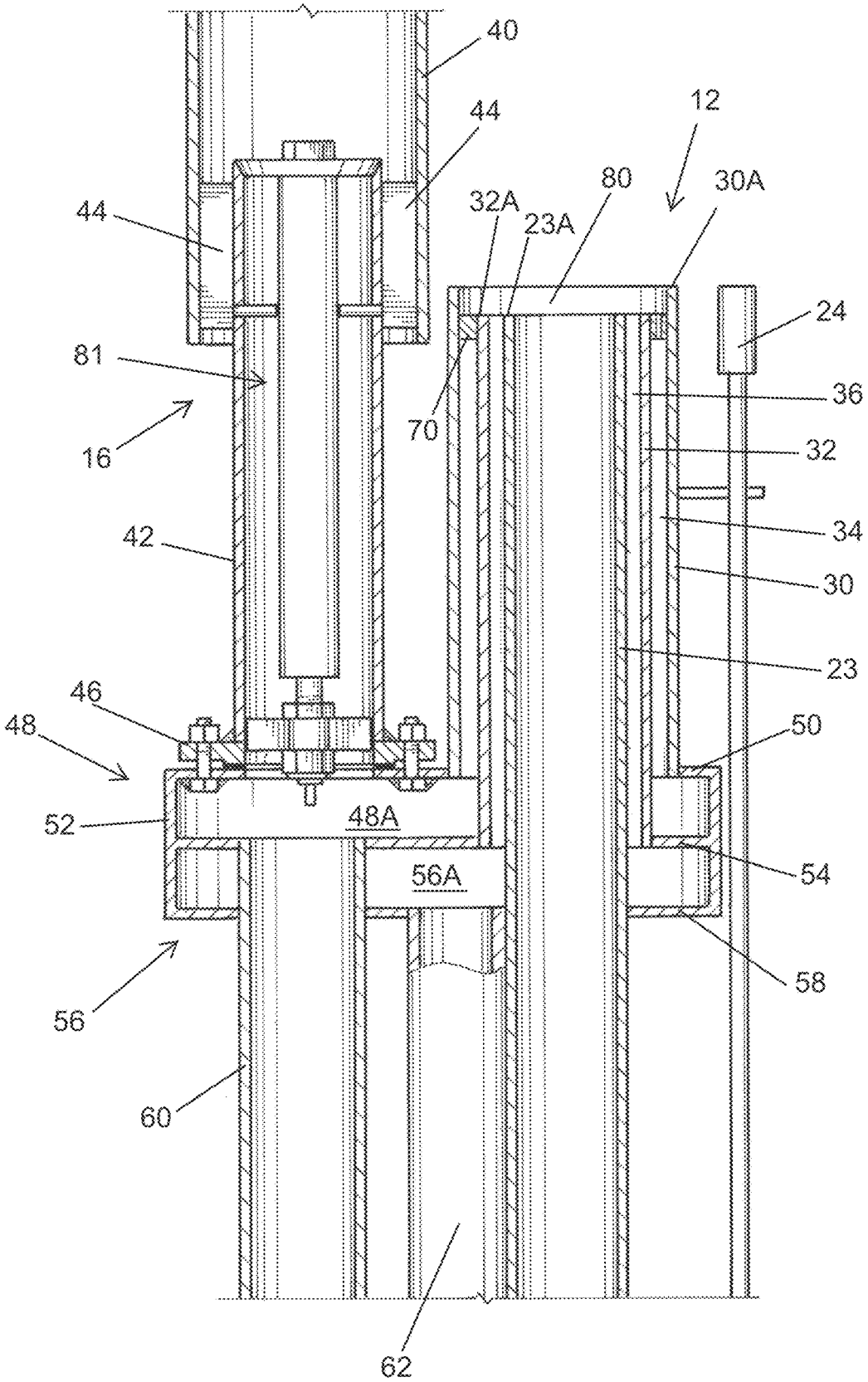
FIG. 3 is an elevational, cross-sectional view of one embodiment of the flare system of the present invention.
Figure 4:
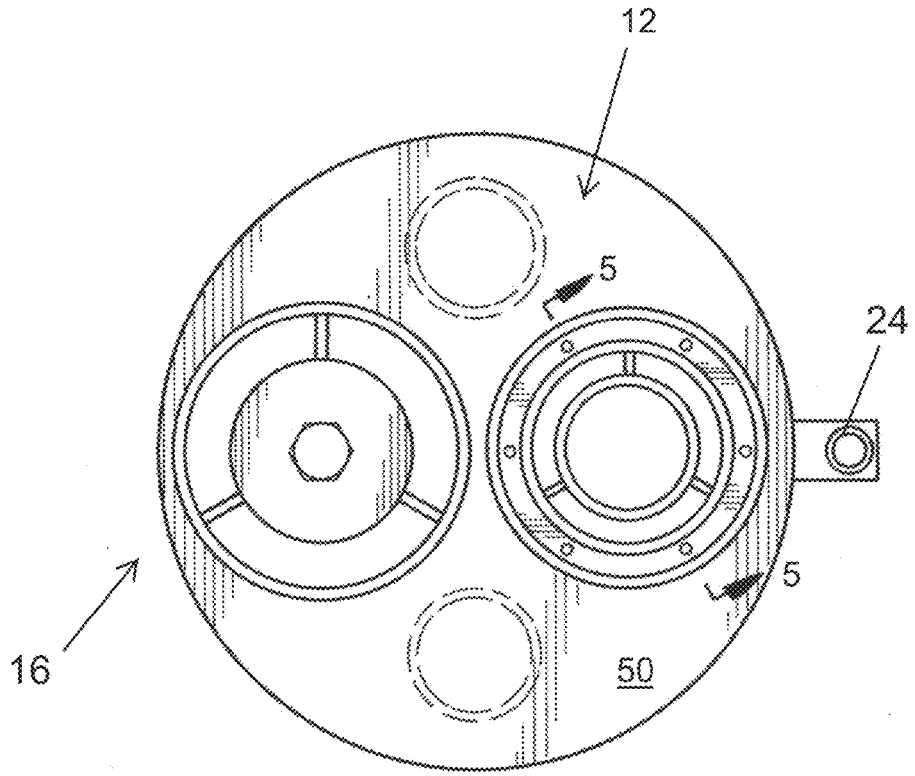
FIG. 4 is a top, plan view of the flare gas system shown in FIG. 3.
Figure 5:
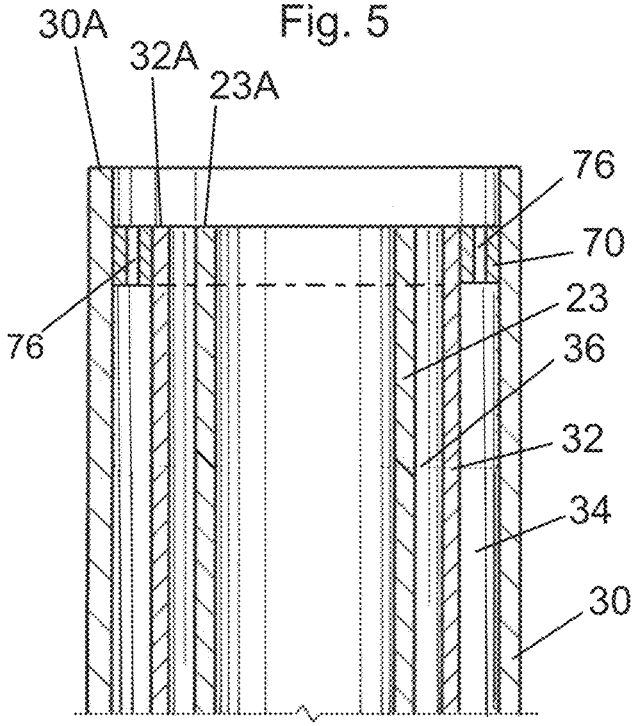
FIG. 5 is a cross-sectional view taken along the lines 5-5 of FIG. 4.

Turning now to FIG. 3, one embodiment of the flare gas system is shown with greater detail with respect to the low pressure flare gas assembly 12 and one of the high pressure flare gas assemblies 16. Low pressure flare gas assembly 12 comprises a first conduit 32 in surrounding relationship to air pipe 23 to form therebetween a first annulus 36. A second tubular conduit 30 is in surrounding relationship to said first tubular conduit 32 to form therebetween a second annulus 34. Air line 23 conveys combustion air from a blower (not shown) but which can be of the type disclosed in U.S. Pat. No. 10,584,873 ('873 patent), the disclosure of which is incorporated herein by reference for all purposes. As can be seen, conduit 30 has an upper, open end 30A while conduit 32 has an upper, open end 32A. Air pipe 23 has an upper, open end 23A, ends 23A and 32A being lower relative to end 30A. The ends 23A and 32A may be from about 2 to about 8 inches below the upper end 30A. Accordingly, there is formed a mixing chamber 80 in the space above air pipe 23 and second conduit 32 as described more fully in the '873 patent.

High pressure flare gas assembly 16 comprises a conduit 40 having an upper open end connected to a tubular housing 42 by a series of ribs 44 welded to the inner surface of conduit 40 and the outer surface of housing 42. The lower end of conduit 40 is also open whereby combustion air can be drawn in. Housing 42 is connected at its lower end via flange fitting 46 to the top wall 50 of a first gas handler 48. Gas handler 48 also has a peripheral side wall 52 and a bottom wall 54 which also forms the top wall of a second gas handler 56, gas handler 56 having a bottom wall 58 as well as peripheral wall 52. As can be seen, gas handlers 48 and 56 form plenums 48A and 56A, respectively, for purposes described more fully hereafter.

A high pressure flare gas feed conduit 60 is connected to and in open communication with the plenum 48A. A low pressure flare gas feed pipe 62 is connected to and in open communication with plenum 56A.

Plenum 48A is in open communication with first annulus 34 as well as the interior of housing 42, whereas plenum 56A is in open communication with annulus 36.

Figure 8:
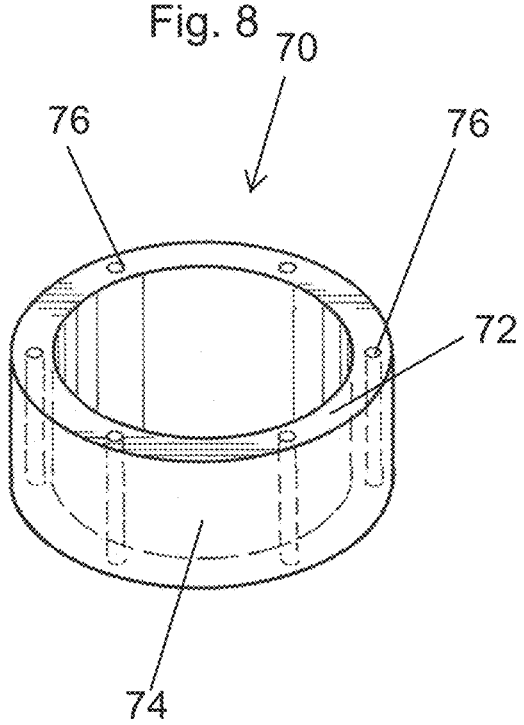
FIG. 8 is a perspective view of one type of flow restrictor for use in the flare gas system of the present invention.

Disposed in annulus 34 is a flow restrictor ring 70 shown in greater detail in FIG. 8. Flow restrictor 70 comprises an annular body 72 having an annular wall 74 longitudinally through which extend orifices 76. While as shown in FIG. 8, restrictor ring 70 has substantial height relative to diameter, in point of fact, the height of flow restrictor 70 can be a little as ¼", e.g., an annular plate through which orifices 76 extend. Although the passages forming orifices 76 are shown as being parallel to the axis of restrictor 70, the passages could be angled such that a swirling motion was induced in mixing chamber 80 by the flare gas issuing from the orifice 76.

Figure 6:
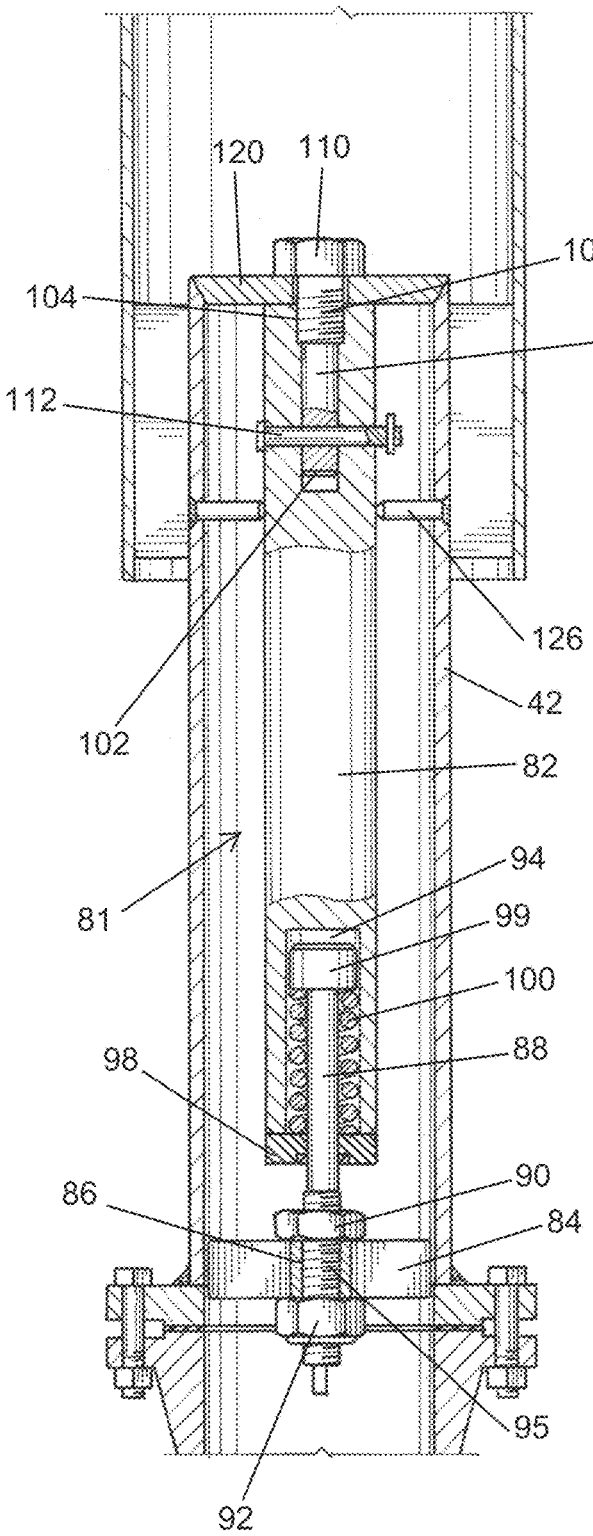
FIG. 6 is a cross-sectional view taken along the lines 6-6 of FIG. 1, showing one embodiment of a pressure operated valve assembly used in one embodiment of the present invention with the valve element in the closed position.

Disposed in housing 42 is a pressure operated valve assembly, e.g., a variable orifice valve assembly, shown generally as 81. As seen in FIG. 6, variable orifice valve assembly 81 comprises a stem 82 which is reciprocally mounted in housing 42. To this end, the first, lower end of stem 82 is formed with a blind bore 94. Received in bore 94 is a threaded bolt 88 having a threaded portion 95 which extends through a collar 86. First and second spaced nuts 90 and 92 on opposite ends of collar 86 which is connected to a bracket 84 which allows bolt 88 to be adjustably secured to a bracket 84 and then locked in place via nuts 90 and 92.

To maintain stem 82 centralized in housing 42, a plurality of circumferentially spaced removable pins 126 extend through the wall of housing 42 and have inner ends which slidingly engage the outer surface of stem 82. Although only two pins 126 are shown, it will be appreciated that in a preferred case, three or four such pins are used. A removable seal 98 is connected to stem 82, e.g., by bolts (not shown) and overlies bore 94, bolt 88 extending therethrough. A compression spring 100 is disposed in bore 94 in surrounding relationship to bolt 88 and is trapped between the head 99 of bolt 88 and seal 98. It will thus be apparent that the compressive force exerted by spring 100 can be varied by rotating bolt 88 to change the distance between the head 99 of bolt 88 and seal 98.

Returning to FIG. 3, in operation according to the method of the present invention, low pressure gas enters plenum 56A via pipe 62 and then passes upwardly through annulus 36 where it exits into mixing chamber 80 formed by ends 23A and 32A of air pipe 23 and second conduit 32. High pressure flare gas enters plenum 48A via pipe 60, a portion being diverted and passed up annulus 34 and through flow restrictor 70 to exit into the mixing chamber 80. The high pressure gas from plenum 48B flows into tubular housing 42. It will be appreciated that flow restrictor 70 increases the velocity of the flare gas from gas handler 48 as it moves out of annulus 34 and through flow restrictor 70 into mixing chamber 80.

As shown in FIG. 6, there is a second blind bore 102 in the opposite end of stem 82. Received in blind bore 102 is a bolt 104, bolt 104 having a threaded portion 106 adjacent bolt head 110 and a thread-free shank 108 which extends into blind bore 102. A removable pin 112 extends through registering bores in stem 82 and bolt 104 whereby bolt 104 is prevented from backing out from blind bore 102.

Figure 7:
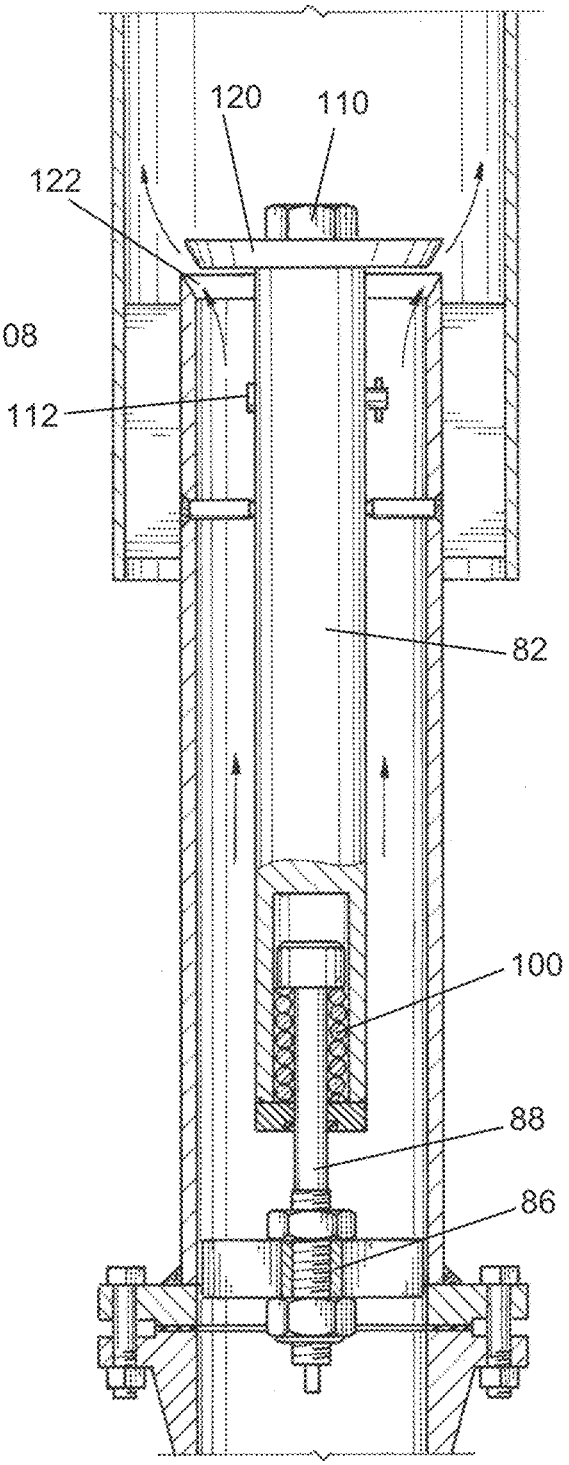
FIG. 7 shows the assembly of FIG. 6 with the valve element in the open position.

The upper end of housing 42 has formed thereon an annular valve seat 122. There is a valve element 120 which is secured to the upper end of stem 82 by means of bolt 104. In the position shown in FIG. 6, the valve element 120 is in the closed position, i.e., the valve element 120 engages seat 122. As can be seen in FIG. 7 valve element 120 is in the open position and has been moved off annular, valve seat 122.

As seen in FIG. 3, high pressure flare gas which is introduced into housing 42 from plenum 48A can act on the underside of valve element 120 and unseat it from seating surface 122 as depicted in FIG. 7. So long as the pressure in housing 42 exceeds the compressive strength of the spring 100, valve element 120 will remain in the opened position shown in FIG. 7. Because of the adjustability of the compressive force exerted by spring 100, the extent to which valve 120 can be moved off of valve seat 122 can be controlled. Further, since the area of the flow path between valve 120 and seat 122 varies directly with the pressure in housing 42, the valve assembly 81 provides variable orifice functionality.

Figure 12:
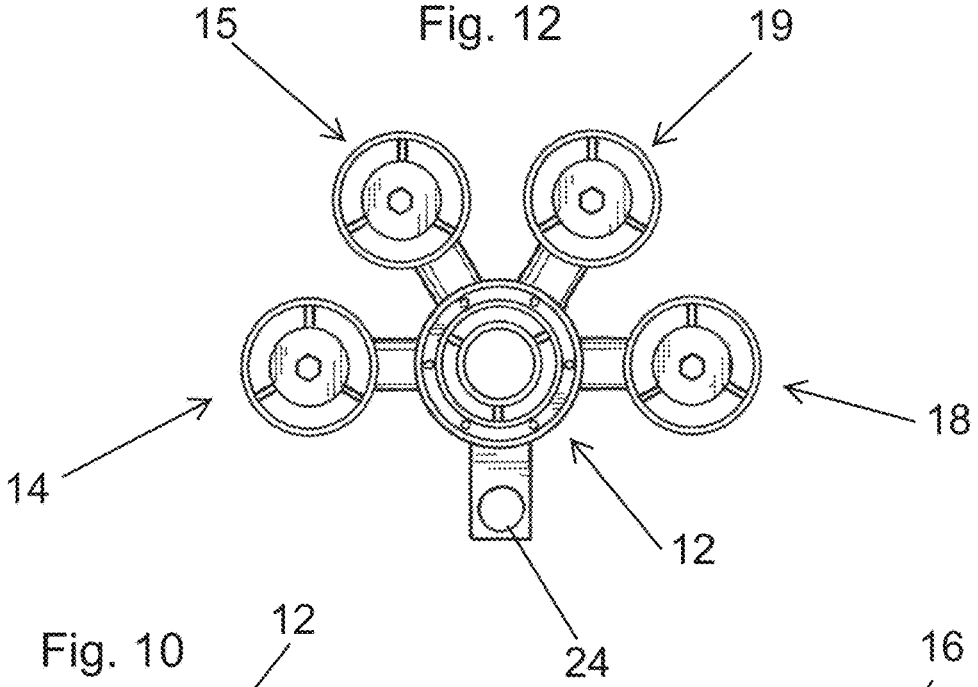
FIG. 12 is a view similar to FIG. 9 showing the flare gas system of the present invention with four high pressure flare gas assemblies.
Figure 10:
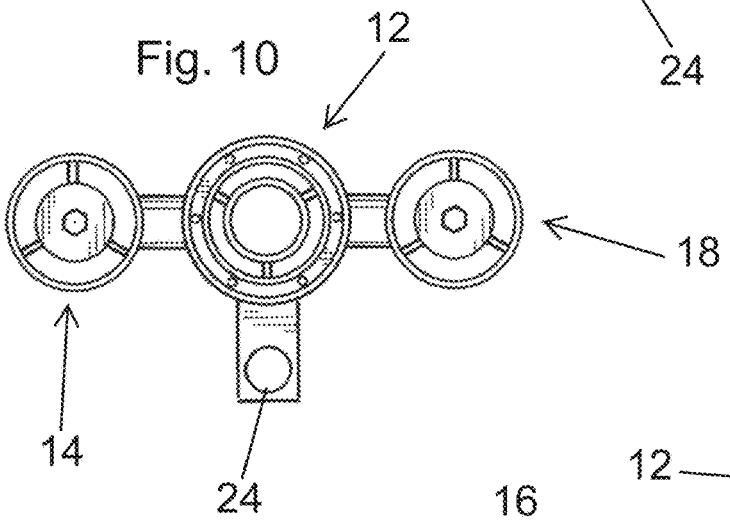
FIG. 10 is a view similar to FIG. 9 showing the flare gas system of the present invention with two high pressure flare gas assemblies.
Figure 9:
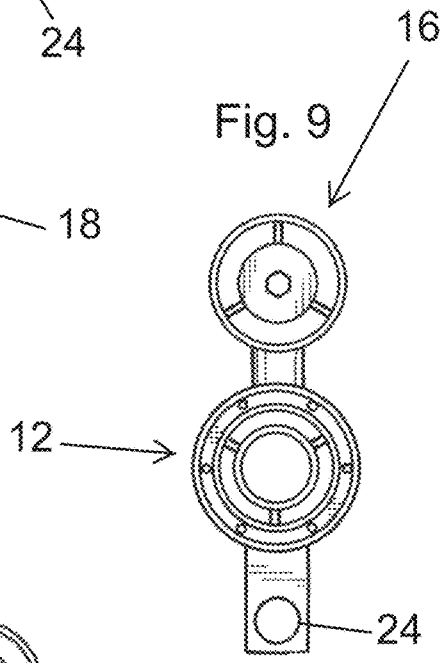
FIG. 9 is a top, plan view of one embodiment of the present invention wherein there is a single high pressure flare gas assembly.
Figure 11:
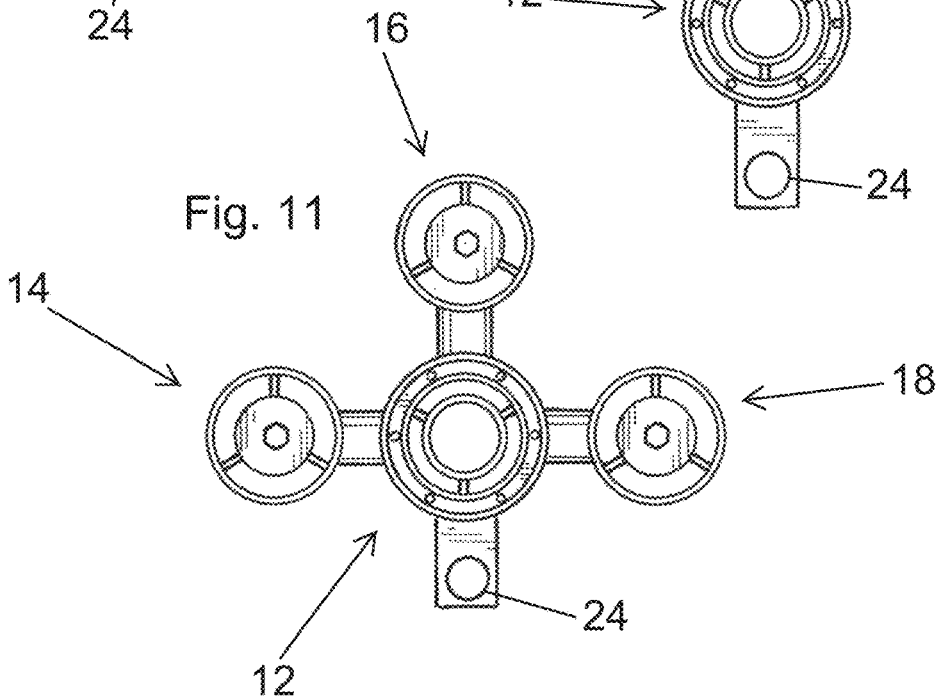
FIG. 11 is a view similar to FIG. 9 showing the flare gas system of the present invention with three high pressure flare gas assemblies.

As can be seen from FIGS. 9-12, the flare gas system of the present invention can comprise a low pressure flare gas assembly 12 and one (FIG. 9), two (FIG. 10), three (FIG. 11), or four (FIG. 12) high pressure flare gas assemblies. FIGS. 9-12 also depict another feature of the present invention. As can be seen from FIGS. 9-12, only a single flare gas igniter 24 is employed. Even in the case of four high pressure flare gas assemblies as shown in FIG. 12, it is been found that a single igniter 24 effectively ignites low pressure flare gas assembly 12 as well as all the flare gases issuing from all the high pressure flare gas assemblies, 14, 15, 18, and 19. This is at least partially due to the novel arrangement of the flow restrictor 70 disposed in annulus 34 which increases the velocity of the flare gas issuing from annulus 34 and effects cross-lighting of not only the low pressure flare gas assembly 12, but the other, high pressure flare gas assemblies connected thereto.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A flare gas system for flaring first and second flare gases comprising:

A) a first flare gas assembly, said first assembly comprising:
- an air pipe;
- a first conduit in surrounding relationship to said air pipe, a first annulus being formed between said air pipe and said first conduit;
- a second conduit in surrounding relationship to said first conduit, a second annulus being formed between said first conduit and said second conduit;
- a flow restrictor disposed in said second annulus;
- a first flare gas handler forming a plenum in open communication with said first annulus;

B) a second flare gas assembly, said second assembly comprising:
- a tubular housing;
- a pressure operated valve assembly mounted in said tubular housing, said pressure operated valve assembly comprising a variable orifice valve assembly;
- a second flare gas handler forming a plenum in open communication with said tubular housing and said second annulus;

whereby at least a portion of said second flare gas flows through said second annulus and said flow restrictor.

2. The flare gas system of claim 1, wherein said flow restrictor comprises a plate having at least one orifice therethrough.

3. The flare gas system of claim 2, wherein there are a plurality of circumferentially spaced orifices.

4. The flare gas system of claim 1, wherein said air pipe has an upper open end, said first conduit has an upper open end, and said second conduit has an upper open end, the upper open ends of said air pipe and said first conduit being below the upper open end of said second conduit.

5. The flare gas system of claim 4, wherein said air pipe upper open end and said first conduit upper open end are from 2 to 8 inches below said second conduit upper open end.

6. The flare gas system of claim 1, wherein there is a single igniter to ignite flare gases emanating from said first and second flare gas assemblies.

7. The flare gas system of claim 1, wherein said pressure operated valve assembly comprises a stem reciprocally mounted in said tubular housing.

8. The flare gas system of claim 7, wherein said stem has a first lower end and a second upper end, said first lower end being operatively connected to a biasing element and said second upper end being connected to a valve element.

9. The flare gas system of claim 8, wherein said biasing element comprises a compression spring disposed in a blind bore formed in the lower end of said stem, said compression spring being in surrounding relationship to an adjustable rod.

10. The flare gas system of claim 9, wherein said adjustable rod comprises a bolt disposed in said first blind bore and having a threaded portion adjustably connected to a mount.

11. The flare gas system of claim 8, wherein said second end of said stem has a second blind bore, said second blind bore having female threads, a bolt being threadedly received in said second blind bore.

12. The flare gas system of claim 8, wherein said housing has an upper end and forms a valve seat for seating engagement by said valve element.

13. The flare gas system of claim 12, wherein said valve element is connected to said stem by said bolt.

14. The flare gas system of claim 1, wherein there are a plurality of said second flare gas assemblies and a single igniter used to ignite gas from said first flare gas assembly and said plurality of second flare gas assemblies.

* * * * *